US005673812A

United States Patent [19]

Nelson

[11] Patent Number: 5,673,812

[45] Date of Patent: Oct. 7, 1997

[54] AUTOMATED GOLF BALL DISPENSER

[75] Inventor: Donald C. Nelson, Medina, Ohio

[73] Assignee: S.G.D., Inc., Medina, Ohio

[21] Appl. No.: 514,324

[22] Filed: Aug. 11, 1995

[51] Int. Cl.[6] ..... G07F 11/00

[52] U.S. Cl. ..... 221/82; 221/265

[58] Field of Search ..... 221/69, 82, 86, 221/265, 264, 277, 311, 200

[56] References Cited

U.S. PATENT DOCUMENTS

| | | | |
|---|---|---|---|
| 3,894,657 | 7/1975 | Eckmayr | 221/265 |
| 4,674,651 | 6/1987 | Scidmore | 221/82 |
| 5,176,285 | 1/1993 | Shaw | 221/86 |

*Primary Examiner*—Kenneth Noland

*Attorney, Agent, or Firm*—Renner, Kenner, Greive, Bobak, Taylor & Weber

[57] ABSTRACT

An automatic golf ball dispenser wherein a hopper containing a large number of golf balls, which rest upon a rotary disc that is driven by a motor. To operate the dispenser, a customer deposits a form of currency into a control box, thereby actuating the rotary disc that will then dispense the desired number of golf balls to the customer. Controls contained within the control box govern various functions such as, how many balls are to be dispensed, ensuring that adequate safety features are in place, and checking that the dispenser is operating in a proper manner. The present invention also has an alternative wherein a signal is transmitted from the control box to a separate receiver indicating when the dispenser is in need of service.

18 Claims, 2 Drawing Sheets

AUTOMATED GOLF BALL DISPENSER

TECHNICAL FIELD

The invention herein resides in the art of currency activated dispensing equipment and, more particularly, to automated golf ball dispensing machines. Specifically, the invention relates to an automated golf ball dispenser that receives cash tendered for golf balls and dispenses a number of such balls in return for such cash.

BACKGROUND ART

The game of golf has become tremendously popular. Both actual play upon a golf course and practice such as at putting greens and driving ranges have become routine pastimes for a large percentage of the populace. With the increasing popularity of golf, the use of driving ranges has increased accordingly. In the never ending quest to improve one's golf game, novice and avid golfers alike spend large amounts of time and money at driving ranges.

At driving ranges, a golfer will typically go to the cashier and request a specific size bucket of balls for a given price. The golfer will then proceed to the practice tee and hit the golf balls with the golf club that is currently causing the most frustration. At some point, after numerous golfers have attempted to correct their swings, the driving range operator will pick up the thousands of golf balls that have been used. Afterwards, the golf balls may be cleaned, and then delivered to the cashier who will manually fill the various size buckets for later use.

In order to reduce the amount of time spent by the cashier manually filling buckets of golf balls and then manually delivering the buckets to customers, golf ball dispensing units have been developed to reduce the aforementioned manual procedures. These units typically are mechanically actuated, requiring the use of levers and internal buckets to deliver the requested number of golf balls. However, these machines are prone to mechanical breakdowns, jams, and inaccuracies thereby causing delays and costs to the driving range operator and resulting in great inconvenience to the customer.

When considered in total, the prior art does not provide a low-maintenance automated golf ball dispenser that is convenient to both the driving range operator and to the golfers wanting to practice their golf swing. The driving range operator requires an automated golf ball dispensing machine, especially if the driving range is operated in conjunction with family recreation centers that include putting courses and batting cages, so as to minimize the required personnel to keep operating expenses at a minimum, and thereby improve the profit margin of the business. The golfer also desires a convenient and reliable way of receiving golf balls to be used on a driving range. Golfers will appreciate an automated golf ball dispenser that provides prompt service and the convenience of a dispensing unit that can deliver a specific number of golf balls.

Accordingly, there is a need in the art for an automated golf ball dispenser to be used at a driving range or golf course which allows for minimal supervision by the operator of the facility and is convenient and easy for golfers to use.

DISCLOSURE OF INVENTION

In light of the foregoing, it is a first aspect of the invention to provide an automated golf ball dispenser that will accept either tokens, coin or paper currency, or a magnetic debit card from a customer and in return deliver a predetermined number of golf balls to the customer.

Another aspect of the invention is to provide an automated golf ball dispenser that can internally monitor the amount of money received, the member of balls dispensed, and check for any mechanical malfunctions.

Still a further aspect of the invention is to provide an automated golf ball dispenser having a sensor that can detect when the number of golf balls remaining in the dispenser has reached a predetermined level and then actuate an appropriate signal light.

An additional aspect of the present invention is to provide an automated golf ball dispenser having a sensor that will stop the dispenser from taking currency when the dispenser has run out of golf balls.

Yet an additional aspect of the invention is to provide an automated golf ball dispenser that is reliable and durable in operation, and that provides cost savings in operation when compared to other methods of distributing golf balls at driving ranges.

It is still another aspect of the present invention to provide an automated golf ball dispenser with a remote signal system that can signal to the owner/operator in a remote location that the unit is either low on golf balls or in need of service.

The foregoing and other aspects of the invention which will become apparent as the detailed description proceeds are achieved by an automated golf ball dispenser, comprising: a hopper adapted to receive a plurality of golf balls therein, said hopper having a chute; a rotary disc disposed within said hopper and at a bottom thereof beneath said golf balls; a motor connected to said rotary disc; and control means connected to said motor for selectively actuating said motor to rotate said disc and dispense golf balls through said chute.

The present invention also provides an apparatus of an automated golf ball dispenser, comprising: a hopper adapted to receive a plurality of golf balls therein, said hopper having a chute; a rotary disc maintained at a bottom portion of said hopper beneath said golf balls; a motor interconnected with said rotary disc; control means connected to and selectively operating said motor to rotate said disc and thereby dispense golf balls through said chute; and a signal light operatively connected to said control means and said hopper for signaling a status of the availability of golf balls in said hopper.

BRIEF DESCRIPTION OF DRAWINGS

For a complete understanding of the objects, techniques, and structure of the invention, reference should be made to the following detailed description and accompanying drawings wherein.

BEST MODE FOR CARRYING OUT THE INVENTION

Figure 1:
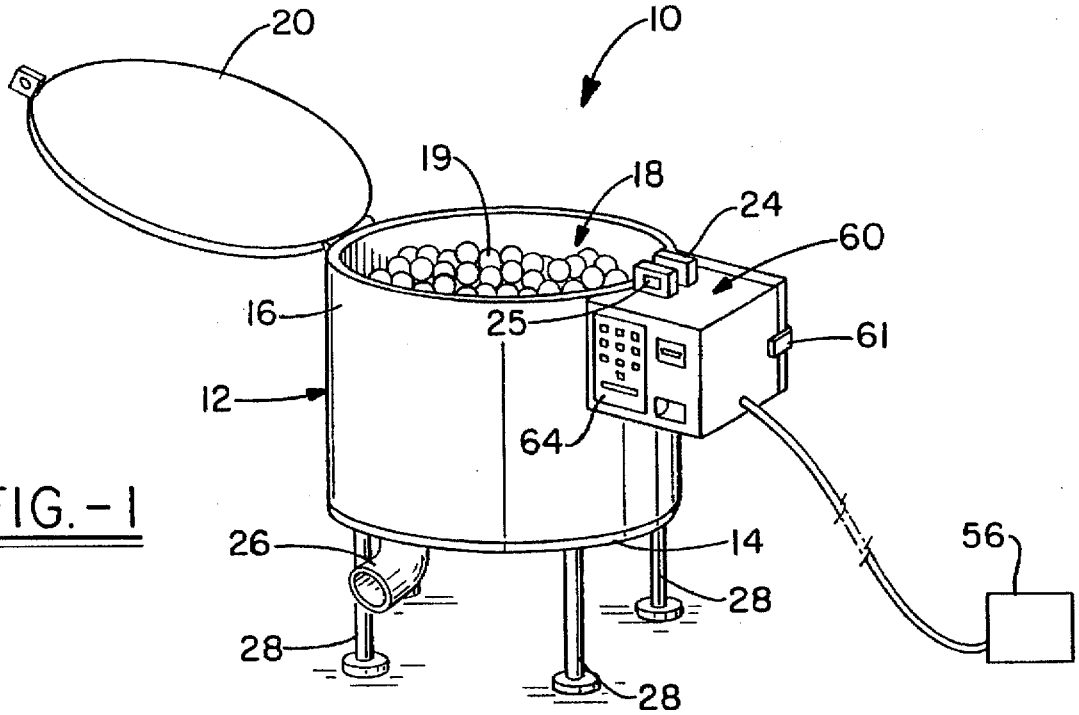
FIG. 1 is a perspective view of an automated golf ball dispenser with microprocessor controls according to the invention.

Referring now to the drawings and more particularly to FIG. 1, it can be seen that an automated golf ball dispenser according to the invention is designated generally by the numeral 10. The ball dispenser 10 includes a hopper 12, which has a base 14 with an upstanding side wall 16 extending therefrom. The base 14 and the side wall 16 form a chamber 18. When in operation, the chamber 18 will be filled with a plurality of golf balls 19. Positioned on the top of the side wall 16 is a lid 20, which has a latch 22 that is mateable with a latch receptacle 24 that is integral with the side wall 16. A lid microswitch 25 or other similar lid detection means is disposed within the latch receptacle 24 to detect the positional relationship of the lid 20. There is a chute 26 at the junction of the base 14 and the side wall 16 which extends outwardly and downwardly from the hopper 12. The hopper 12 may be supported by a plurality of legs 28. Of course, the geometric configuration of the hopper 12 may vary as desired, the same being shown as cylindrical for purposes of discussion herein.

Figure 2:
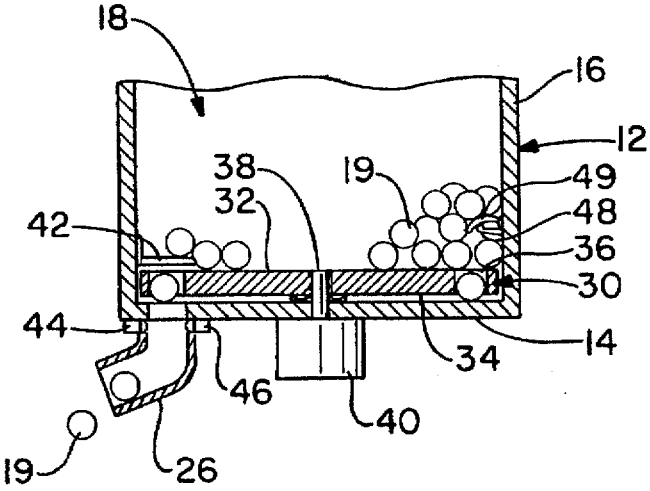
FIG. 2 is a partial sectional view of the automated golf ball dispenser showing a ball dispensing mechanism that includes a rotary disc, a delivery chute, a drive mechanism, a photo sensor and a low ball sensor.

Referring now to FIG. 2, those skilled in the art will appreciate that a rotary disc 30 is disposed within the chamber 18 underneath the plurality of golf balls 19. The disc 30 has a top side 32 and a bottom side 34, with a plurality of holes 36 extending completely through the disc and arranged around the periphery thereof. Each of the holes 36 is large enough to accept and pass one and only one golf ball 19 at a time, although other variations of the invention may have larger holes to accept other multiples of golf balls. Of course, once received by the hole 36, the ball 19 is supported by the base 14. The disc 30 also has a center axis 38 that is drivingly connected to a motor 40, which selectively rotates the disc in a desired direction and at a desired speed. Although the motor 40 is shown on the underside of the base 14, it will be appreciated that the motor 40 could be disposed between the bottom side 54 and the base 14, within the medial portion of the disc 30, or on the top side 32. As can further be seen in FIGS. 2 and 3, a chute plate 42 is detachably connected within the chamber 18 to the side wall 16, above the top side 32 of the rotary disc 30. The chute plate 42 is positioned over the disc 30 so that as the disc 30 rotates, the golf ball holes 36 will be sequentially completely covered when the hole becomes substantially aligned with the chute 26. The chute plate 42 effectively wipes the rotating disc 30 and blocks or seals the passage defined by the holes 36 and chute 26 from the chamber 18.

As is illustrated in FIG. 2, disposed within the chute 26, beneath the disc 30, is a photo-light source 44, which is in substantial alignment with a photo detector 46. Therefore, as the disc 30 rotates with a golf ball 19 contained within the hole 36, the golf ball will drop down the chute 26 as it passes thereover. Thus, as the golf ball 19 interrupts the light source 44, the detector 46 will register that a ball has passed therethrough. The passage of other balls 19 from the chamber 18 to the chute 26 is prevented by the positioning of the chute plate 42.

As further shown in FIG. 2, a low-ball microswitch 48 may be positioned above the base 14. The weight of the golf balls 19 upon a spring plate 49 keeps the plate deflected to keep the switch 48 actuated. When the number of balls upon the spring plate 49 is insufficient to deflect the plate to maintain the actuated state of the switch 48, the output of the switch is then indicative of the number of golf balls 19 contained within the chamber 18 being "low" or below a predetermined level.

Figure 3:
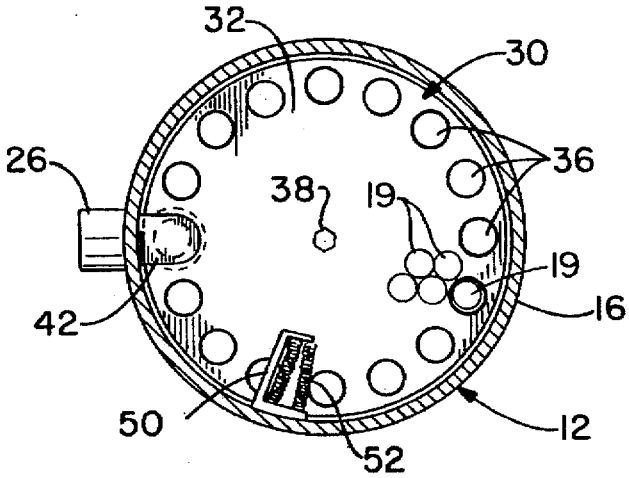
FIG. 3 is a top view of the rotary disc of the automated golf ball dispenser according to the invention.

Referring now to FIG. 3, it can be seen that a C-shaped guide plate 50 is detachably mounted to the side wall 16, within the chamber 18, above the top side 32 of the rotary disc 30. Attached to and extending across the opening of the plate 50 are a plurality of springs 52. The guide plate 50 is positioned such that as the disc 30 rotates toward the chute plate 42, the springs 52 will urge a golf ball 19 into a golf ball hole 36. Thus, if a golf ball 19 has not already dropped into an empty hole 36 as the hole rotates around the hopper, the guide plate 50 and springs 52 will function to urge a ball into a position aligned therewith. As the empty hole 19 moves underneath such a ball 19, the ball will drop therein so that it can subsequently exit out the chute 26.

Figure 4:
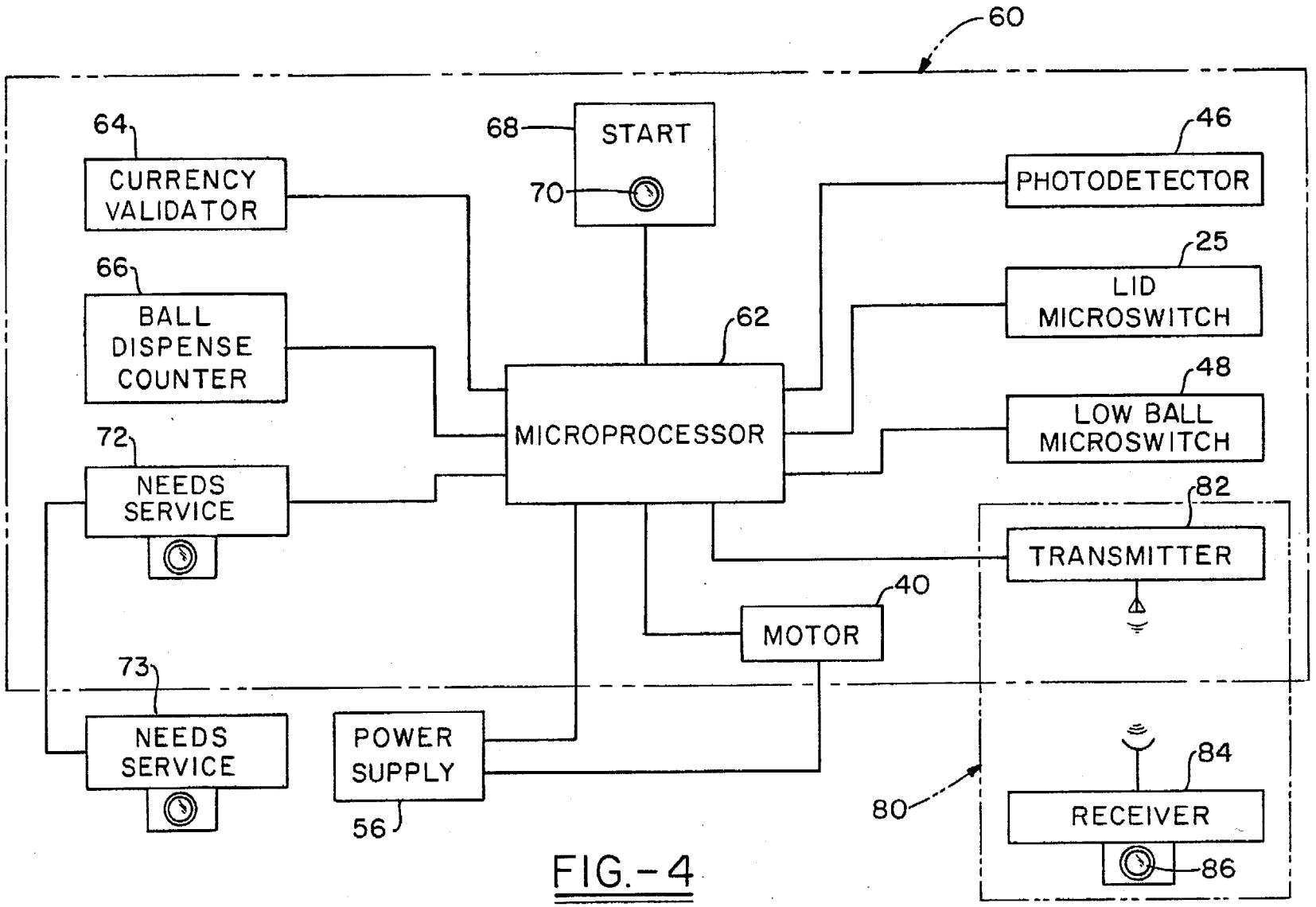
FIG. 4 is a schematic drawing of the control system of the automated golf ball dispenser according to the invention.

Referring back to FIG. 1, it can be seen that a control box 60 is attached to the hopper 12. Access to the control box 60 is governed by a control box lock 61. Referring now to FIG. 4, those persons skilled in the art can see that the control box 60 contains a control device or microprocessor 62, which receives and sends electrical signals from the photo detector 46, the lid microswitch 25, the low-ball microswitch 48, and the motor 40. Also contained in the control box 60 and in operative relationship with the microprocessor 62 are a currency validator 64, a balls dispensed counter 66, a start button 68, a start light 70 disposed within the start button, and a "Needs Service" light 72. The power supply 56, typically 120 VAC, is electrically and operatively connected to the motor 40 and to the microprocessor 62.

Therefore, in actual operation, the automated golf ball dispenser 10 shown generally in FIG. 1 will operate when the chamber 18 has been filled with golf balls 19, and the lid 20 has been dosed, thereby activating the lid microswitch 25. First, a customer will enter the appropriate currency, tokens or magnetic debit card into the currency validator 64 located on the control box 60. The validator 64 will verify the currency or deduct the appropriate amount from the debit card and then signal the amount entered to the microprocessor 62, which in turn will set the appropriate number of balls to be dispensed on the balls dispensed counter 66. Concurrently, the microprocessor will activate the start light 70, contained within the start button 68. At this time the customer may enter more money into the validator 64, thus increasing the counter 66, or the customer may push the start button 68. Once the start button 68 has been actuated a signal is sent to the microprocessor 60, which in turn activates the motor 40 to rotate the disc 30 accordingly. As the disc 30 rotates, a golf ball hole 36 with a golf ball 19 disposed therein, will proceed underneath the chute plate 42 until the golf ball hole is substantially aligned with the chute 26, whereupon the golf ball will be dispensed to the customer. If the ball hole 36 happens to be empty, a golf ball 19 will generally be urged therein by the guide plate 50 and associated springs 52. Of course, the top side 32 could be sloped downwardly to assist in urging the golf balls 19 toward the holes 19. As should be apparent to those skilled in the art, the chute plate 42 functions to allow only let one ball be dispensed at a time by effectively sealing the aligned hole 36 and chute 26 from the interior of the chamber 18. Furthermore, it should be appreciated that as the golf ball 19 is dispensed through the chute 26, the photo-detector 46 will register the action accordingly, and send an appropriate signal to the microprocessor 62, which in turn will reduce or decrement the counter 66 by one. This process repeats as the periphery of the disc 30 rotates over the chute 26 until such time as the counter 66 reaches zero. Upon sensing that the counter 66 has counted out, the microprocessor 62 stops the motor 40 and thus the rotary disc 30, and simultaneously deactivates the start light 70, terminating the dispensing operation.

There are several other conditions under which the microprocessor 62 will signal the motor 40 to stop or refrain from starting. The first condition would occur if the lid microswitch 25 indicates that the lid 20 is in the open position. This is done to prevent unwarranted access into the hopper 12 and as a safety mechanism to prevent the dispenser 10 from being activated while it is in the process of being serviced.

A second condition for stoppage of the dispenser 10 occurs when the low-ball microswitch 48 detects that the weight of the golf balls 19 upon the spring plate 49 has decreased to indicate that a "low level" of balls remain in the chamber 18. Typically, the spring plate 49 is selected such that this value is between 150 and 200 balls. Accordingly, to be certain the chamber 18 never runs completely empty, the microprocessor 62 will start counting down from a number less than 150, such as 100, as the balls 19 are dispensed through the chute 26 until the microprocessor counter reaches 0. When this occurs, the microprocessor 62 will, after finishing the present dispensing cycle, disable the currency validator 64 to preclude further operation and simultaneously signal the start light 70 to flash intermittently, indicating that the unit needs service, or by turning the "Needs Service" light 70 on.

A final condition under which the dispenser 10 will shut down is when the photo detector 46 fails to register a golf ball 19 exiting the chute 26 within a predetermined interval during a dispensing cycle. More particularly, the microprocessor 62 will be pre-set such that if during a dispensing cycle a ball 19 does not exit within a period of two seconds, for example, the microprocessor will stop the motor 40 from rotating the disc 30, and simultaneously signal the start light 70 to flash intermittently, which indicates that the unit needs service, or by lighting the "Needs Service" light 72. It is within the scope of the present invention that a second "Needs Service" light 73 could be located away from the ball dispenser 10 to more easily gain the attention of service personnel. A stoppage of this type could result from a malfunction of one of the internal components in the control box 60, a malfunction in the motor 40, a foreign object jamming the rotary disc 30, or a foreign object lodged between the chute plate 42 and the rotary disc. Furthermore, although not shown, other microswitches or detection devices could be input to the microprocessor 62 to control the operation of the dispensing unit 10.

Of course, the dispenser 10 could operate without inclusion of the low-ball microswitch 48. In this embodiment, the dispenser 10 would rely on the capability of the microprocessor 62 to detect that a golf ball 19 has not exited within a predetermined period of time. This method of operation presumes that all of the golf balls 19 have exited the chamber 18 such that the light source 44 and detector 46 have not registered a ball passing therethrough during the predetermined time period. After the predetermined period of time has elapsed, the microprocessor 62 stops the motor 40 and activates the "Needs Service" lights 72 and 73.

A further embodiment is also depicted in FIG. 4, which shows a remote signal system generally designated by the numeral 80. The remote signal system 80 includes a transmitter 82, which is enclosed within the control box 60 and a receiver 84, which is separate from the dispenser 10 and has a signal light 86 contained thereon.

In actual operation, the remote signal system 80 will be operatively connected to the microprocessor 62 such that whenever the microprocessor 62 receives a signal that the chamber 18 is low on golf balls 19 or that there is some other type of malfunction within the unit 10, the microprocessor will send a corresponding signal to the transmitter 82 as discussed above. Consequently, the transmitter 82 will send an appropriate signal to the receiver 84, which will actuate the signal light 86. Ideally, the signal light 86 will be seen immediately by the appropriate personnel so that the dispenser 10 can be inspected.

Thus it can be seen that the objects of the invention have been satisfied by the structure presented above. It should be apparent to those skilled in the art that the objects of the present invention could be practiced with any type of ball or object as disclosed herein to accommodate variations in ball size.

While two preferred embodiments of the invention have been presented and described in detail, it will be understood that the invention is not limited thereto or thereby. Accordingly, for an appreciation of the true scope and breadth of the invention, reference should be made to the following claims.

What is claimed is:

1. An automated golf ball dispenser, comprising:

a hopper, adapted to receive a plurality of golf balls therein, said hopper having a chute;

a rotary disc disposed within said hopper, and at a bottom thereof beneath said golf balls;

a motor connected to said rotary disc;

means for detecting when said plurality of golf balls have reached a predetermined low level; and control means connected to said motor for selectively actuating said motor to rotate said disc and dispense golf balls through said chute, said control means connected to said detecting means wherein said control means disables operation of the dispenser a predetermined period lifter the predetermined low level is detected.

2. The golf ball dispenser according to claim 1, wherein said hopper has a base with an upwardly extending side wall, said base and said side wall forming a chamber, said side wall having a latch receptacle; and a lid that is closable on the top of said sidewall, said lid having a latch that lockably mates with said latch receptacle.

3. The golf ball dispenser according to claim 2, wherein said rotary disc has a top side and a bottom side, there being a plurality of holes around the periphery of the disc extending completely therethrough, said disc being operatively connected to said motor on said bottom side.

4. The golf ball dispenser according to claim 3, said detecting means including a low ball microswitch operatively closed by a spring plate when said golf balls are disposed thereon and operatively open when said golf balls are removed, said spring plate being mountably attached within said chamber.

5. The golf ball dispenser according to claim 4, wherein said side wall has a chute plate extending therefrom and over said top side of said disc such that when one of said holes, with a golf ball disposed therein, becomes substantially aligned with said chute, said hole is completely covered so that only one golf ball may exit at a time.

6. The golf ball dispenser according to claim 5, wherein said chute has a light source substantially opposite a photo detector, which is operatively connected to said control means such that when a golf ball is dispensed said detector sends an appropriate signal to said control means.

7. The golf ball dispenser according to claim 6, wherein said side wall has attached thereto biasing means for urging said golf balls into said holes.

8. The golf ball dispenser according to claim 7, wherein said biasing means further comprises: a C-shaped guide plate mountably secured to said side wall, and substantially aligned with the rotational path of said holes; and a plurality of springs disposed within said C-shaped guide plate to urge said golf balls into said holes.

9. The golf ball dispenser according to claim 8, wherein said control means comprises:

a microprocessor, said microprocessor electrically operative with said low-ball microswitch, said photo detector, and said motor;

a currency validator which is electrically operative with said microprocessor;

a balls dispensed counter which is electrically operative with said microprocessor;

a start button which is electrically operative with said microprocessor;

a needs service indicator which is electrically operative with said microprocessor; and a power supply which is electrically operative with said microprocessor and said motor.

10. An automated golf ball dispenser, comprising:

a hopper, adapted to receive a plurality of golf balls therein, said hopper having a chute;

a rotary disc maintained at a bottom portion of said hopper, beneath said golf balls;

a motor interconnected with said rotary disc;

control means connected to and selectively operating said motor to rotate said disc and thereby dispense golf balls through said chute;

a low ball microswitch connected to said control means and operatively closed by a spring plate when said golf balls are disposed thereon and operatively open when said golf balls are removed, wherein said spring plate is mountably attached within said hopper; and a signal light operatively connected to said control means and said hopper for signalling a status of said dispenser.

11. The golf ball dispenser according to claim 10, wherein said hopper has a base with an upwardly extending side wall, said base and said side wall forming a chamber, said side wall having a latch receptacle; and a lid that is closable on the top of said sidewall, said lid having a latch that lockably mates with said latch receptacle.

12. The golf ball dispenser according to claim 11, wherein said rotary disc has a top side and a bottom side, there being a plurality of holes around the periphery of the disc extending completely therethrough, said disc being operatively connected to said motor on said bottom side.

13. The golf ball dispenser according to claim 10, wherein said low ball microswitch sets a counter to a predetermined number in said control means when operatively open, said control means counting down the number of balls dispensed from the predetermined number and disabling the dispenser when the counter reaches zero.

14. The golf ball dispenser according to claim 12, wherein said side wall has a chute plate extending therefrom and over said top side of said disc such that when one of said holes, with a golf ball disposed therein, becomes substantially aligned with said chute, said hole is completely covered so that only one golf ball may exit at a time.

15. The golf ball dispenser according to claim 14, wherein said chute has a light source substantially opposite a photo detector, which is operatively connected to said control means such that when a golf ball is dispensed said detector sends an appropriate signal to said control means.

16. The golf ball dispenser according to claim 15, wherein said side wall has attached thereto biasing means for using said golf balls into said holes.

17. The golf ball dispenser according to claim 16, wherein said biasing means further comprises: a C-shaped guide plate mountably secured to said side wall, and substantially aligned with the rotational path of said holes; and a plurality of springs disposed within said C-shaped guide plate to urge said golf balls into said holes.

18. The golf ball dispenser according to claim 17, wherein said control means comprises:

a microprocessor, said microprocessor electrically operative with said low-ball microswitch, said photo detector, and said motor;

a currency validator which is electrically operative with said microprocessor;

a balls dispensed counter which is electrically operative with said microprocessor;

a start button which is electrically operative with said microprocessor;

a needs service indicator which is electrically operative with said microprocessor; and a power supply which is electrically operative with said microprocessor and said motor.

* * * * *